US006224484B1

(12) United States Patent
Okuda et al.

(10) Patent No.: US 6,224,484 B1
(45) Date of Patent: May 1, 2001

(54) PROGRESSIVE GAMING SYSTEM

(75) Inventors: Yoichi Okuda, Yokohama; Koichi Ozaki, Zama; Takashi Yamaguchi, Yokohama; Keiichi Yoshida, Ebina; Junichi Sasa, Yokohama, all of (JP)

(73) Assignee: Konami Co., Ltd., Hyogo-ken (JP)

( * ) Notice: Subject to any disclaimer, the term of this patent is extended or adjusted under 35 U.S.C. 154(b) by 0 days.

(21) Appl. No.: 09/085,089

(22) Filed: May 26, 1998

(30) Foreign Application Priority Data

May 28, 1997 (JP) ..... 9-138294

(51) Int. Cl.[7] ..... A63F 9/24
(52) U.S. Cl. ..... 463/27; 463/17; 463/20
(58) Field of Search ..... 463/27, 17, 25, 463/26, 12, 16, 13, 42, 20; 273/292, 138.1, 143 R, 274, 122 R, 138.2, 85 CP

(56) References Cited

U.S. PATENT DOCUMENTS

| | | | | |
|---|---|---|---|---|
| 4,624,459 | * | 11/1986 | Kaufman | 273/143 R |
| 4,652,998 | * | 3/1987 | Koza et al. | 273/274 |
| 4,837,728 | | 6/1989 | Barrie . | |
| 5,116,055 | | 5/1992 | Tracy . | |
| 5,288,077 | * | 2/1994 | Jones | 273/292 |
| 5,318,298 | * | 6/1994 | Kelly et al. | 273/122 R |
| 5,542,669 | * | 8/1996 | Charron et al. | 463/13 |
| 5,611,730 | | 3/1997 | Weiss . | |
| 5,645,486 | * | 7/1997 | Nagao et al. | 463/27 |
| 5,876,283 | * | 3/1999 | Parra et al. | 463/12 |
| 5,876,284 | * | 3/1999 | Acres et al. | 463/25 |
| 5,885,158 | * | 3/1999 | Torango et al. | 463/27 |
| 5,911,626 | * | 6/1999 | McCrea, Jr. | 463/27 |
| 5,913,726 | * | 6/1999 | Jones et al. | 463/13 |
| 5,947,821 | * | 9/1999 | Stone | 463/13 |
| 5,964,464 | * | 10/1999 | Jones | 273/292 |
| 5,967,514 | * | 10/1999 | Kelly et al. | 273/118.1 |
| 6,102,799 | | 8/2000 | Stupak . | |

FOREIGN PATENT DOCUMENTS

| | | |
|---|---|---|
| 7-148307 | 6/1995 | (JP) . |
| 8-117446 | 5/1996 | (JP) . |
| 9-1922289 | 7/1998 | (JP) . |
| 9-192289 | 7/1998 | (JP) . |

* cited by examiner

*Primary Examiner*—Valencia Martin-Wallace
*Assistant Examiner*—John Paradiso
(74) *Attorney, Agent, or Firm*—Jordan and Hamburg LLP

(57) ABSTRACT

A progressive gaming system comprises a plurality of gaming machines, each of which is constructed to perform a predetermined main game in response to an operation of a player and gives a prize to the player when a winning combination is formed in the main game; and a progressive unit for counting an amount of a progressive bonus based on an amount of a bet in the main game played in each of the gaming machines and controlling a payment of the progressive bonus in association with a result of the main game. Each of the gaming machines or the progressive unit is provided with a judging device for judging whether or not the result of the main game played in each of the gaming machines meets a predetermined bonus chance condition for proceeding to a lottery game. The progressive unit comprises a controller for performing the lottery game in response to a judgment that the result of the main game meets the bonus chance condition, instructing one of the gaming machines, in which the result of the main game meets the bonus chance condition, to pay the progressive bonus corresponding to a result of the lottery game, and displaying information regarding to a process of the lottery game.

20 Claims, 8 Drawing Sheets

PROGRESSIVE GAMING SYSTEM

BACKGROUND OF THE INVENTION

1. Field of the Invention

The present invention relates to a progressive gaming system capable of giving a prize, such as pay-out of coins, tokens and the like, for a winning combination formed in a main game played in each of gaming machines associated with each other, and capable of giving a bonus prize, value of which can be progressively increased.

2. Description of the Related Art

A progressive gaming system is known as a system in which a certain rate of medals, coins or tokens, bet in a plurality of gaming machines are collectively accumulated as a progressive bonus, and when a specific combination is formed in any gaming machine, the progressive bonus is paid out to a player of that gaming machine to thereby give the feeling of a so-called jackpot to the player (for example, refer to U.S. Pat. No. 4,837,728).

In this type of the gaming system, the condition for getting the progressive bonus is tended to strictly set in consideration of the character of the progressive bonus. As an example in a poker game machine, only a combination having an extremely low probability such as a so-called royal straight flush is set as a combination for which the progressive bonus is paid out.

However, the setting of the above mentioned strict condition reduces a frequency at which the progressive bonus is paid out, so that the interest of the player is lost. In particular, an interval between each of the pay-out of the progressive bonuses is extremely long in a small system in which only several gaming machines are connected to a single progressive unit, and the value of the progressive bonus accumulated between the intervals is not largely increased. Therefore, the player tends to play the game without substantially giving attention to the existence of the progressive unit.

A system described below is proposed in Japanese Patent Application Laying Open (KOKAI) No.7-148307 which is equivalent to U.S. Pat. No. 5,645,486. That is, if a predetermined combination associated with a bonus chance is formed in the main game played in the gaming machine, the progressive unit performs a lottery as to whether or not the progressive bonus should be paid out in accordance with a probability adjusted in consideration of the amount of the bets by the player at that time. Then, the progressive bonus is paid out in a case of the win in the lottery. According to this system, a chance of getting the progressive bonus is increased to thereby enable the player to be conscious of the existence of the progressive bonus. However, in the above mentioned system, only whether or not the progressive bonus should be paid out is determined by the lottery, and only the result of the lottery is displayed to the player. Thus, this system is not sufficient to impress the existence of the progressive unit on the player. Moreover, there may be a case that even if the progressive bonus is paid out, the player can not understand the reason of the pay-out. For this reason, this system is not sufficient to make the interest of the player to the gaming system with the progressive unit stronger than the interest to the gaming machine without the progressive unit.

In the progressive gaming system, it can be possible that a plurality types of the main games are selectively performed in each of the gaming machines liked to the common progressive unit. However, in this case, the probabilities at which the winning combinations are formed are changed on the basis of the game types. Therefore, it is difficult to uniformly generate the chances of getting the progressive bonuses. Unless the progressive bonuses are appropriately distributed by considering that point, the interest of the player to the progressive gaming system is reduced on the contrary.

SUMMARY OF THE INVENTION

It is an object of the present invention to provide a progressive gaming system improved which is more attractive to a player stronger.

In order to attain the above object, a progressive gaming system of the present invention comprises a plurality of gaming machines, each of which is constructed to perform a predetermined main game in response to an operation of a player and gives a prize to the player when a winning combination is formed in the main game; and a progressive unit for counting an amount of a progressive bonus based on an amount of a bet in the main game played in each of the gaming machines and controlling a payment of the progressive bonus in association with a result of the main game; wherein each of the gaming machines or the progressive unit is provided with a judging device for judging whether or not the result of the main game played in each of the gaming machines meets a predetermined bonus chance condition for proceeding to a lottery game; and wherein the progressive unit comprises a controller for performing the lottery game in response to a judgment that the result of the main game meets the bonus chance condition, instructing one of the gaming machines, in which the result of the main game meets the bonus chance condition, to pay the progressive bonus corresponding to a result of the lottery game, and displaying information regarding to a process of the lottery game.

According to the above progressive gaming system, if the result of the main game met the bonus chance condition, the lottery game is performed on the side of the progressive unit, and the process thereof is displayed to the player as well as the result thereof. Therefore, the existence of the progressive unit can be strongly emphasized to the player during the lottery game, as compared with the conventional system. This causes the interest of the player to the gaming system with the progressive unit to be much stronger than the interest to the gaming machine without the progressive unit, and further makes the worth of the progressive gaming system extremely higher.

The controller may perform a game as the lottery game for forming at least one bonus winning combination, and may display a process as to whether or not the at least one bonus winning combination is formed. In this case, the player can understand that the lottery game different from the main game performed on the main gaming machine is progressing on the progressive unit, and therefore the existence of the progressive unit is strongly impressed on the player.

The progressive unit may comprise a display device extending on the plurality of the gaming machines, and the information regarding to the process of the lottery game may be displayed through the display device. In this case, since the process of the lottery game different from the main game is displayed above the player's head by the display device, it is possible to impress the player with the progressive unit as the unit different from each gaming machine.

The progressive unit may comprise a display device equipped with at least one video monitor for displaying the information regarding to the process of the lottery game. In this case, it is possible to display various information to the player through the video monitor.

The controller may perform a game as the lottery game in which characters are randomly combined, and may control the display device in such a manner that images representing a process of combining the characters are displayed on the at least one video monitor. In this case, the player has expectations by watching the process of combining, so that the existence of the progressive unit is further impressed on the player.

The controller may determine a combination of characters provided on a plurality of reels in the lottery game, and may control the display device in such a manner that images representing a process that each of the reels starts rotating and stops at a position corresponding to the determined combination of the characters are displayed on the at least one video monitor. In this case, the player has expectations through watching the process of the motion of the reels.

In the above progressive gaming system, the controller may perform a judgment as to whether or not the determined combination of the characters in the lottery game meets a predetermined bonus winning condition for paying the progressive bonus, and may instruct the payment of the progressive bonus when it is judged that the determined combination of the characters meets the bonus winning condition. A plurality of bonus winning combinations may be set as the bonus winning condition, and the controller may judge whether or not the determined combination meets at least one of the bonus winning combinations. The controller may determine a value to be paid to the player as the progressive bonus in such a manner that the value is changed in accordance with types of the bonus winning combinations, and may instruct the one of the gaming machines to pay the determined value as the progressive bonus.

At least one bonus chance combination may be set as the bonus chance condition for proceeding to the lottery game, and the judging device may judge whether or not the at least one bonus chance combination is formed in the main game played in each of the gaming machines. The at least one bonus chance combination can include a combination different from the winning combination, or the at least one bonus winning combination may be limited to a combination different to the winning combination of the main game.

A part of the gaming machines can perform one type of a game, as the main game, different from another type of a game performed in a remnant part of the gaming machines as the main game, and the controller can perform a game for forming at least one bonus winning combination as the lottery game, instruct the payment of the progressive bonus when the at least one bonus winning combination is formed in the lottery game and change a probability of forming the at least one bonus winning combination in accordance with a type of the main game.

The bonus chance condition may be set in such a manner that a plurality of bonus chances can be occurred in one of the main game in anyone of the gaming machines, and the controller may repeat the lottery game a number of times corresponding to a number of the bonus chances when the plurality of the bonus chances are occurred.

In another preferred aspect of the present invention, there is provided a progressive gaming system comprising: a plurality of gaming machines, each of which is constructed to perform a predetermined main game in response to an operation of a player and gives a prize to the player when a winning combination is formed in the main game; and a progressive unit for counting an amount of a progressive bonus based on an amount of a bet in the main game played in each of the gaming machines and controlling a payment of the progressive bonus in association with a result of the main game played in each of the gaming machines; wherein each of the gaming machines or the progressive unit is provided with a judging device for judging whether or not the result of the main game played in each of the gaming machines meets a predetermined bonus chance condition for proceeding to a lottery game; and wherein the progressive unit comprises a controller for performing a game as the lottery game for forming at least one of bonus winning combinations in response to a judgment that the result of the main game meets the bonus chance condition, instructing one of the gaming machines, in which the result of the main game meets the bonus chance condition, to pay the progressive bonus varied in accordance with types of the bonus winning combinations when one of the bonus winning combinations is formed in the lottery game.

According to this gaming system, since the lottery game different from the main game performed on the main gaming machine is performed in the progressive unit, it is possible to emphasized the existence of the progressive unit to the player. The value of the progressive bonus to be paid to the player is varied in accordance with types of the bonus winning combinations. In particular, the value of the progressive bonus can be adjusted in accordance with the frequency of forming each bonus winning combination to thereby increase chances of getting the progressive bonus. This adjustment can excite the interest of the player in the lottery game.

In a further preferred aspect of the present invention, there is provided a progressive gaming system comprising: a plurality of gaming machines, each of which is constructed to perform a predetermined main game in response to an operation of a player and gives a prize to the player when a winning combination is formed in the main game; and a progressive unit for counting an amount of a progressive bonus based on an amount of a bet in the main game played in each of the gaming machines and controlling a payment of the progressive bonus in association with a result of the main game played in each of the gaming machines; wherein each of the gaming machines or the progressive unit is provided with a judging device for judging whether or not at lease one bonus chance combination including a combination different from the winning combination is formed in the main game played in each of the gaming machines; and wherein the progressive unit comprises a controller for performing a lottery in response to a judgment that the at least one bonus chance combination is formed, instructing one of the gaming machines, in which the at least one bonus chance combination is formed, to pay the progressive bonus corresponding to a result of the lottery.

According to this gaming system, there is a case that the controller performs the lottery game even if the winning combination is not formed in the main game as long as the bonus chance combination is formed. Therefore, it is possible to impress the player with the progressive unit as the unit different from each gaming machine to thereby excite the player's interest in the progressive gaming system. In this gaming system, the term "lottery" is not limited to a process performed with a process capable of being recognized by the player, and then it includes a type of determining the success or failure by an inner process and only the result thereof is showed to the player.

In a still further preferred aspect of the present invention, there is provided a progressive gaming system comprising:

a plurality of gaming machines, each of which is constructed to perform a predetermined main game in response to an operation of a player and gives a prize to the player when a winning combination is formed in the main game; and a progressive unit for counting an amount of a progressive bonus based on an amount of a bet in the main game played in each of the gaming machines and controlling a payment of the progressive bonus in association with a result of the main game played in each of the gaming machines; wherein a part of the gaming machines can perform one type of a game as the main game different from another type of a game performed in a remnant part of the gaming machines as the main game; wherein each of the gaming machines or the progressive unit is provided with a judging device for judging whether or not the result of the main game played in each of the gaming machines meets a predetermined bonus chance condition varied in accordance with a type of the main game; and wherein the progressive unit comprises a controller for performing a lottery game for forming at least one bonus winning combination in response to a judgment that the result of the main game meets the bonus chance condition, instructing one of the gaming machines, in which the result of the main game meets the bonus chance condition, to pay the progressive bonus when the at least one bonus winning combination is formed in the lottery game, and changing a probability of forming the at least one bonus winning combination in accordance with a type of the main game.

According to this gaming system, since the probability of getting the progressive bonus is varied on the basis of the type of the main game played in each gaming machine. This can make the setting of the allotment of the progressive bonus more freely. Therefore, it is possible to attain the allotment based on the interest of the player and then cause the attraction of the player to the gaming system with the progressive unit to be much stronger than the attraction to the gaming machine without the progressive unit. Even if the probability at which the bonus chance condition is satisfied, or the pay-out rate per the bet value is different between each of the gaming machines in accordance with the type of the main game, this difference can be canceled by the adjustment of the probability of getting the progressive bonus to thereby dissolve the unevenness between each gaming machine.

In the above mentioned progressing gaming systems of the present invention, the type of the main game does not matter, if a win is obtained in the main game by combining a plurality of characters, such as letters, figures and symbols. For example, a slot machine game, a poker machine game, a mahjong game and the like can correspond to the main game. The lottery game can be changed as long as the result thereof can be displayed through the display of the process capable of being recognized by the player. For example, a race game is allowable as the lottery game.

Still further objects, features and other aspect of the present invention will be understood from the following detailed description of the preferred embodiments of the present invention with reference to the accompanying drawings.

DETAILED DESCRIPTION OF THE PREFERRED EMBODIMENT

Figure 2:
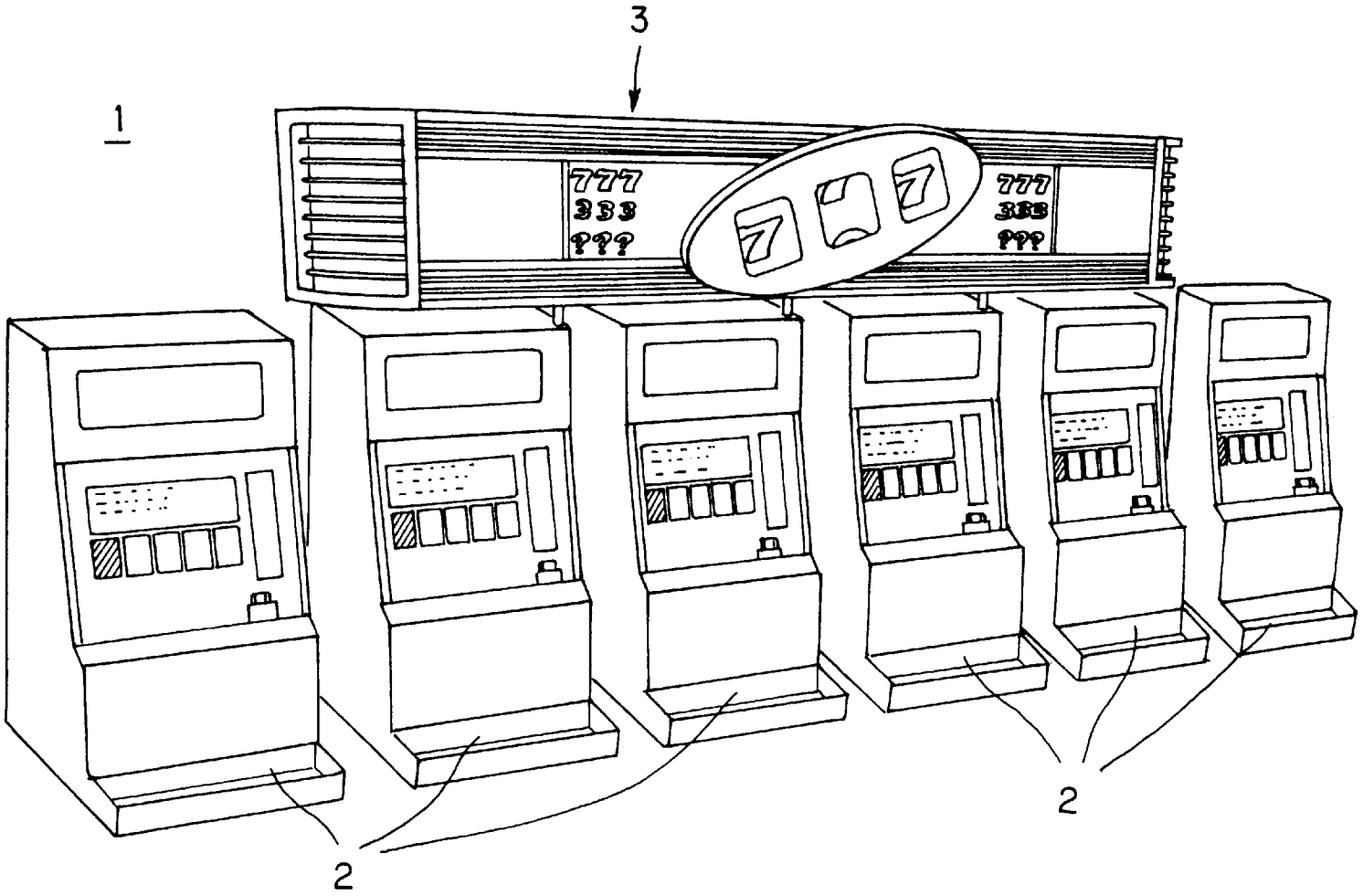
FIG. 2 is a perspective view showing an exterior of the progressive gaming system.

FIG. 2 shows an exterior of a progressive gaming system to which the present invention is applied. This system 1 is provided with six gaming machines 2 . . . aligned in a row and a progressive unit 3 laying on the top surfaces of inner four gaming machines 2. The number of the gaming machines 2 . . . can be changed to two or more. The arrangement of the gaming machines 2 . . . is not limited to the row, but rather may be changed to a ring, a back-to-back style, a zigzag and other various arrangements.

Figure 3:
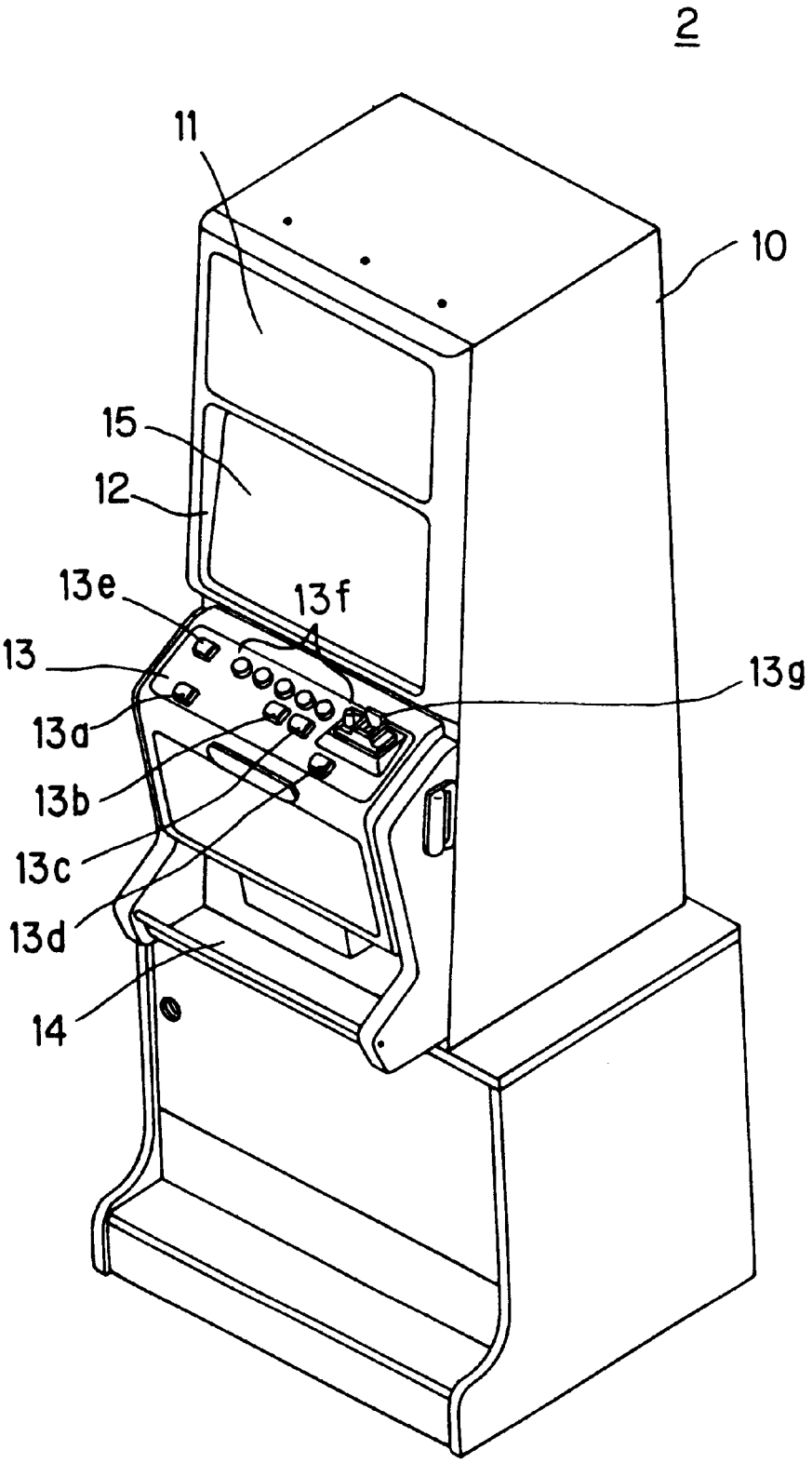
FIG. 3 is a perspective view showing an exterior of a gaming machine.

As shown in FIG. 3, the gaming machine 2 has an upright body 10. From the top on the front side of the body 10 toward the bottom thereof, there is provided a title panel 11, an image display portion 12, an operation panel 13 and a medal dish 14. Letters and Figures for representing a name of the gaming machine 2, a type of a game and the like are displayed on the title panel 11. A monitor 15 equipped with a CRT (cathode ray tube), a LCD (liquid crystal display) panel or the like is provided in the image display portion 12 with the screen thereof being slightly upward inclined. This monitor 15 can display images required to play a predetermined game in the gaming machine 2.

Figure 4A:
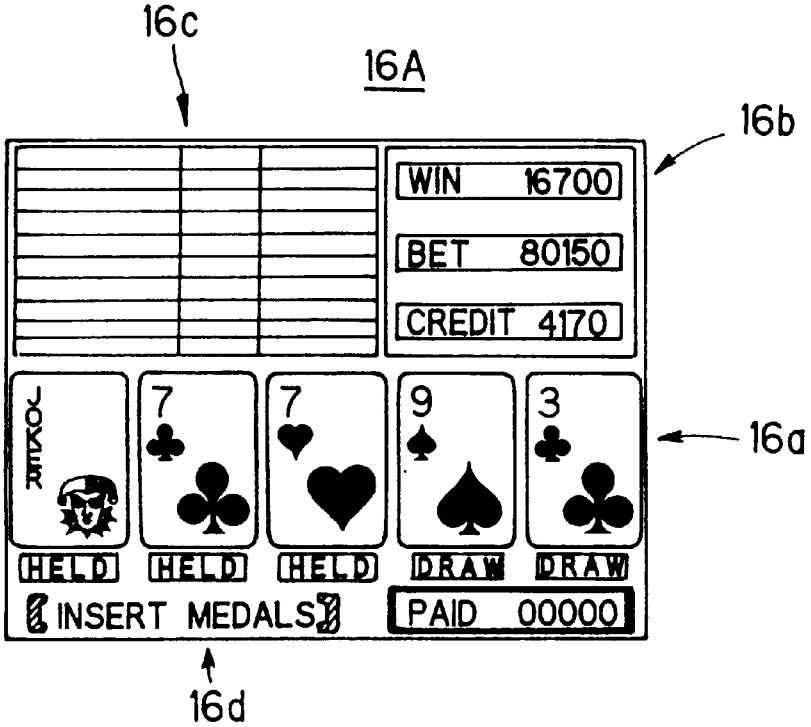
FIG. 4A is a view showing an example of an image displayed in the gaming machine when a porker machine game is played therein.
Figure 4B:
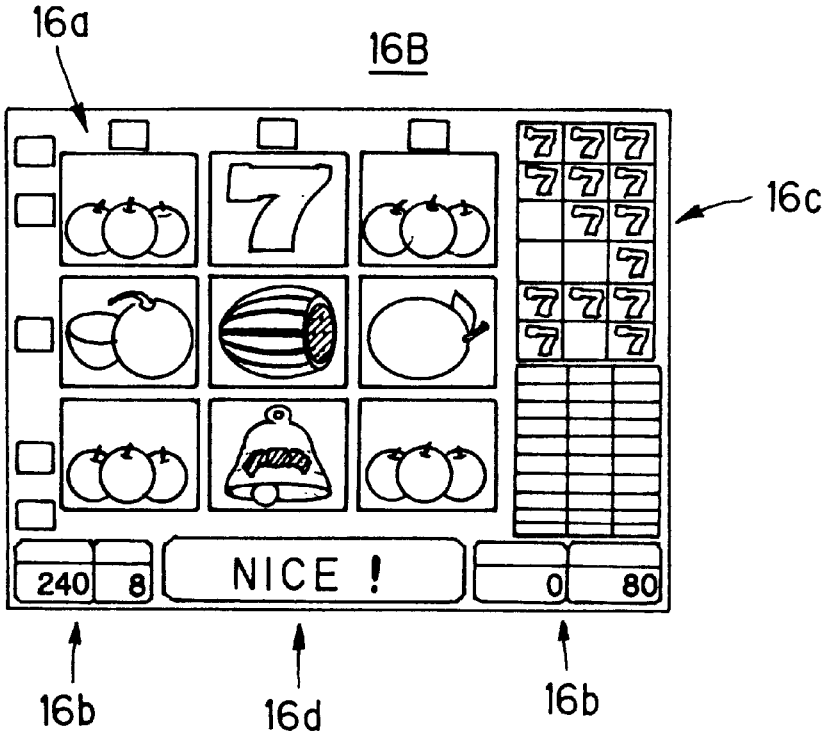
FIG. 4B is a view showing an example of an image displayed in the gaming machine when the slot machine game is played therein.

FIGS. 4A and 4B show examples of images displayed on the screen of the monitor 15. Namely, FIG. 4A shows an image 16A when a poker machine game is played, and FIG. 4B shows an image 16B when a slot machine game is played. These images are variously changed on the basis of the type of the game. Each of the images 16A and 16B typically contains a combination display portion 16*a* in which characters, such as letters, symbols, figures or the like, forming a combination are displayed, a medal number display portion 16*b* for displaying a number of medals to be paid out for a win, a number of bet medals and a number of credit medals, a winning combination display portion 16*c* for displaying winning combinations in the main game played in the gaming machine 2, and an information display portion 16*d* for displaying information, such as an instruction of operation, a result of the game and the like, regarding to the state of the main game. In FIG. 2, the images for the poker machine game are displayed in the image display portions 12 of all gaming machines 2. However, part or all of them may be changed for other games. It may be possible that one game can be selected as the main game among a plurality of games in each gaming machine 2.

As shown in FIG. 3, the operation panel 13 is provided with buttons 13*a*, 13*b* . . . 13*f* for receiving various operations necessary for playing the game and a medal insert slot 13*g* through which medals are inserted. The medals inserted into the medal insert slot 13*g* are accumulated in a predetermined storage means and paid out to the medal dish 14 as necessary. The storage means of the medals may be disposed within each gaming machine 2, or a common storage means may be disposed for the six gaming machines 2.

Figure 5:
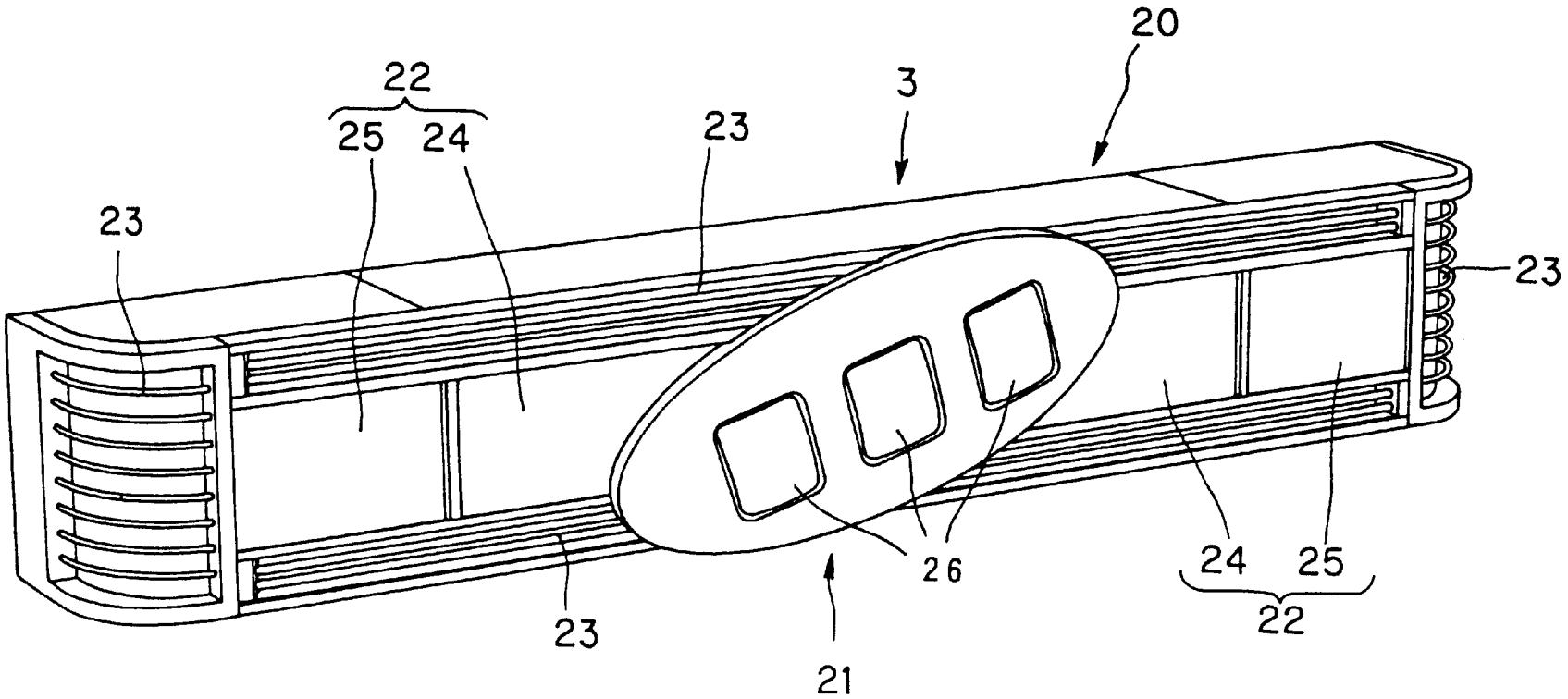
FIG. 5 is a view showing an exterior of a progressive unit.

As shown in FIG. 5, the progressive unit 3 has a lateral body 20. A game display portion 21 is provided at a center on a front side of the body 20, and bonus value display portions 22, 22 are provided on both sides thereof, respectively. The game display portion 21 is intended to display the process of a lottery game played in the progressive unit 3 as well as the result of the lottery game. The configuration of the game display portion 21 can be appropriately changed on the basis of the type of the lottery game. In the illustrated example, a slot machine game using three reels is played in the progressive unit 3, so that the progressive unit 3 is provided with three video monitors 26, each of which is equipped with a CRT, a LCD or the like, to display images representing a process that the three reels start rotating and stop at randomly selected timing. The video monitors 26 are arranged along a line inclining so as to deviate upward from the horizontal direction as it goes to the right side thereof. A mechanical rotatable reels may be installed instead of the video monitors 26. Only one video monitor may be provided for representing all of the video reels.

Figure 6:
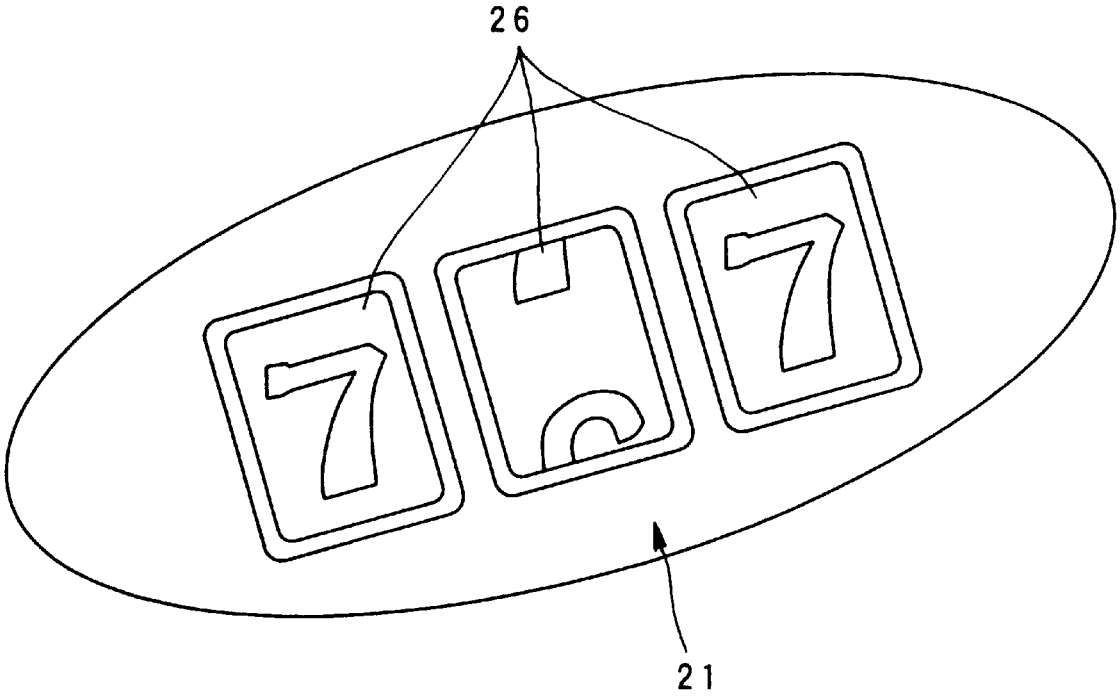
FIG. 6 is an enlarged view of a game display portion disposed at the center of the progressive unit.

FIG. 6 shows an example of the display manner in the game display portion 21 when the slot machine game as a lottery game is played in the progressive unit 3. In this example, a state at which the two reels are stopped at the same position indicating the character of [7] is displayed on the two video monitors 26, 26 on both sides, and a state at which the reel is on the way of its rotation is displayed on the central video monitor 26. Since the process of the lottery game, namely the process that the three reels start rotating and stop at randomly selected timings, is displayed to the player as mentioned above, it is possible to surely attract the player to the progressive unit 3 in comparison with the conventional gaming system in which only the result of the lottery game is displayed to the player.

Figure 7:
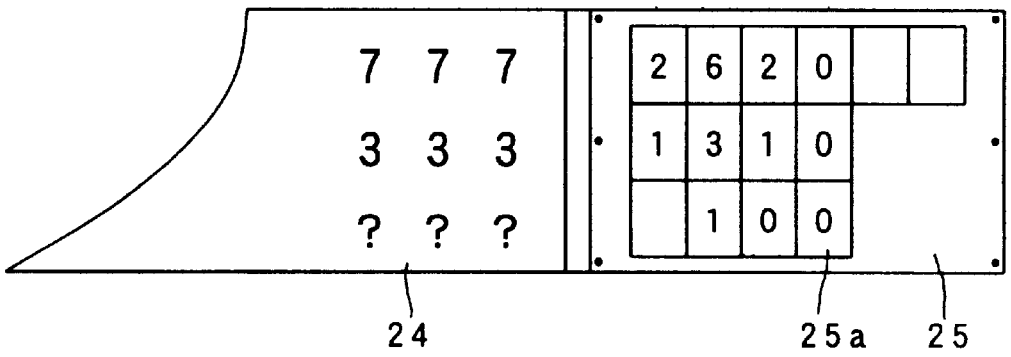
FIG. 7 is an enlarged view of a bonus value display portion disposed own the right side of the progressive unit.

As shown in FIG. 7, the bonus value display portion 22 is provided with a winning combination display panel 24 and a bonus value display panel 25. Bonus winning combinations in the slot machine game played in the progressive unit 3 are displayed on the winning combination display panel 24, and the number of the bonus medals corresponding to each bonus winning combination is displayed on the bonus value display panel 25. Three bonus winning combinations of [777], [333] and [???] are displayed in the illustrated example. A plurality of segment type light emitting devices 25*a* . . . are provided in the bonus value display panel 25 so as to be arranged in three rows corresponding to the three winning combinations. The bonus winning combination of [???] means a combination in which the same characters on the three reels are arranged in a line. Although FIG. 7 shows the right bonus value display portion 22 of the game display portion 21, the configuration of the display portion 22 on the opposite side is similar to that of the right display portion. If the bonus winning combinations in the game played in the progressive unit 3 is fixed at predetermined combinations, the winning combination display panel 24 may have a configuration that the bonus winning combinations are printed or carved on a decoration panel. However, if the bonus winning combinations in the progressive unit 3 are variable, it is necessary that the winning combination display panel 24 is constituted by the variably displaying means, such as the segment type light emitting devices or the like, similarly to the bonus value display panel 25.

As shown in FIG. 5, electrically decorating portions 23 . . . are disposed on left and right ends and upper and lower edges of the body 20. Each electrically decorating portion 23 is constituted by a combination of various light emitting materials, such as a stroboscopic lamp, an LED and the like. Various productions can be performed by appropriately changing the light emitting patterns of the electrically decorating portions 23.

Figure 1:
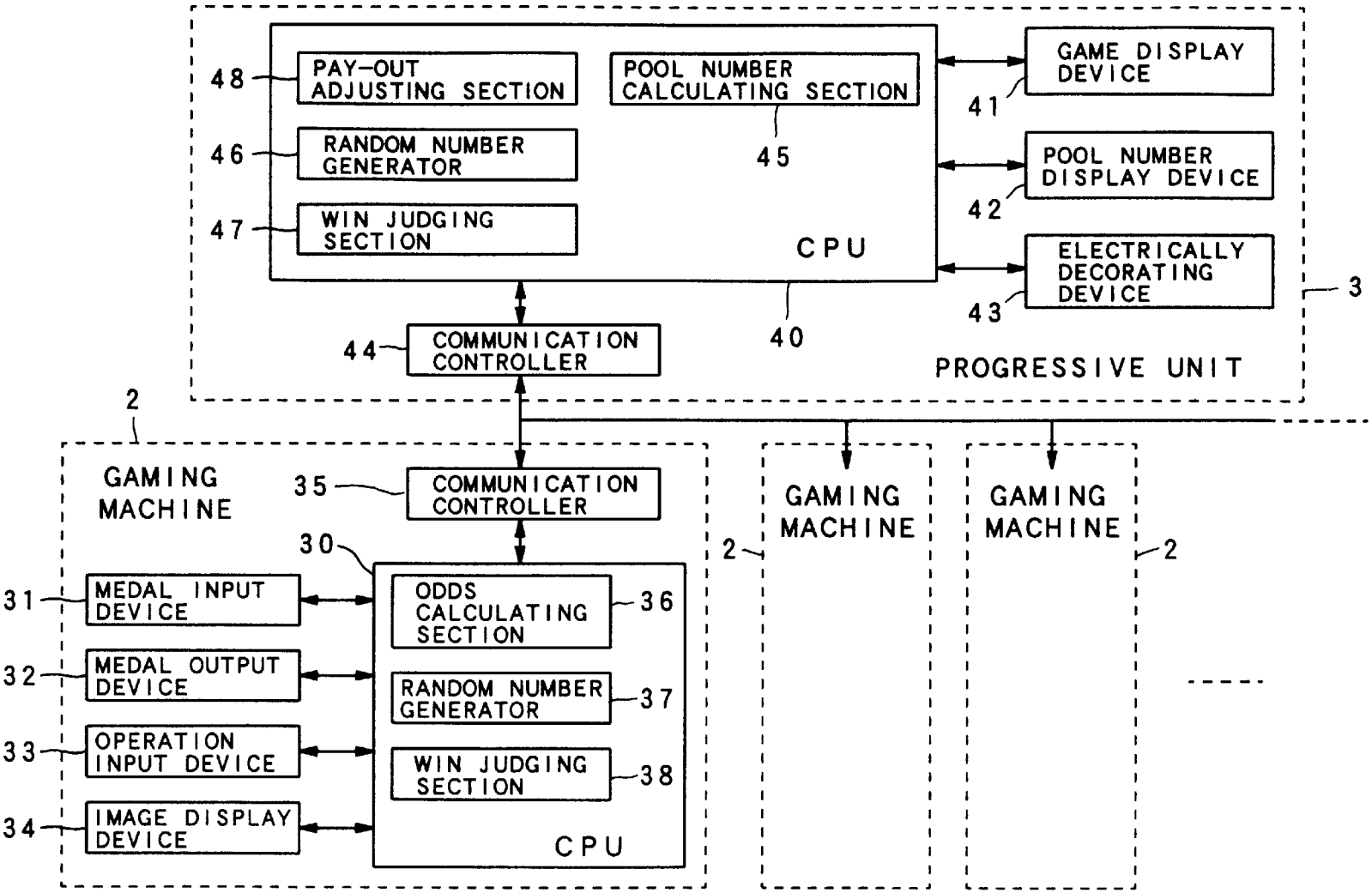
FIG. 1 is a block diagram of a control system in a progressive gaming system according to an embodiment of the present invention.

FIG. 1 is a block diagram of a control system in the gaming system 1. Since the block configurations of the respective gaming machines 2 are identical to each other, only one gaming machine 2 is detailed in FIG. 1. As can be seen from this diagram, the control system in the gaming machine 2 is provided with a CPU 30, and the CPU 30 is connected to a medal input device 31, a medal output device 32, an operation input device 33, an image display device 34 and a communication controller 35. The CPU 30 is constituted by a combination of a microprocessor, various peripheral chips necessary for the operations of the microprocessor, memory device such as ROM, RAM and the like, and other peripheral components. The CPU 30 performs the various calculations necessary for the progress of the game and the control of the various devices, in accordance with a program stored in the ROM.

The medal input device 31 judges whether the medal inserted into the medal insert slot 13*g* is true or imitated (refer to FIG. 3). If judging as the truth, it outputs a signal indicating the insertion of the medal to the CPU 30, and also sends out the medal to the predetermined storage means. If judging as the falsehood, it returns the medal to the medal dish 14. The medal output device 32 takes out the medals, the number of which is instructed by the CPU 30, from the storage means, and sends out the medals to the medal dish 14. The operation input device 33 outputs a signal corresponding to the operation from each of the buttons 13*a*, 13*b* . . . on the operation panel 13 to the CPU 30. The image display device 34 comprises the above mentioned monitor 15 and a drive circuit necessary for the display control of the monitor 15, and displays the proper information in accordance with the instruction from the CPU 30 on the monitor 15. The communication controller 35 performs a data communication between the progressive unit 3 and the gaming machine 2 in accordance with the instruction from the CPU 30.

An odds calculating section 36, a random number generator 37 and a win judging section 38 are constituted within the CPU 30 by a combination of the microprocessor and a particular software. The odds calculating section 36 calculates a number of the medals to be paid out for each winning combination based on the number of the bet medals, and also calculates an assigned number of the medals to be accumulated as a progressive bonus. The random number generator 37 generates the random number necessary for the progress of the main game. For example, when a card game is played in the gaming machine 2, cards to be delivered to the player is determined in accordance with the random number generated by the random number generator 37. Similarly, when a slot machine game is played in the gaming machine 2, a combination of the characters on the three reels is determined in accordance with the random number. The win judging section 38 operates as a judging device. Namely, the win judging section 38 judges whether or not the combination determined in accordance with the random number generated by the random number generator 38 corresponds to the winning combination in the main game played in the gaming machine 2, and also judges whether or not the combination corresponds to a bonus chance combination for proceeding to the lottery game played in the progressive unit 3, by referring to the data with regard to the winning combinations and the bonus chance combinations which are stored within the ROM of the CPU 30.

The setting of the winning combinations in each main game played in each gaming machine 2 is limited in accordance with the custom of the main game. For example, in case of the poker machine game, a combination so called royal straight flash, full house or the like should be treated as the winning combination. And in case of the slot machine game, a combination in which the same characters are arranged in a lateral or a slant direction should be treated as the winning combination. On the contrary, the bonus chance combination may be freely instituted without such limitations. It can be possible to treat a combination which is not treated as the winning combination in the main game as the bonus chance combination. For example, in case that one pair of [7], [7] is formed in the poker machine game as shown in FIG. 4A, or in case that the same characters are arranged at four corners in a matrix consists of three rows and three columns defined on the three reels in the slot machine game as shown in FIG. 4B, it can be possible to treat these combinations as the bonus chance combinations. Of course, the bonus chance combination can be selected among the winning combinations in the main game played in the gaming machine 2. On the contrary, it can be possible to limit the bonus chance combination to a combination different from the winning combination in the main game. Moreover, for example, the bonus chance combination can be associated with a plurality of play results in such a manner that the bonus chance combination is completed when the play result, in which the same two characters among the three reels are arranged in a line in the slot machine game, is repeated three times. Further, it can be possible to set the bonus chance combination in such a manner that two or more bonus chances are generated in one of the main game. In this case, the lottery game is repeated the number of times corresponding to the number of the bonus chances by the progressive unit 3.

As shown in FIG. 1, the control system in the progressive unit 3 is provided with a CPU 40 as a controller, and the CPU 40 is connected to a game display device 41, a pool number display device 42, an electrically decorating device 43 and a communication controller 44. The CPU 40 is constituted by a combination of a microprocessor, various peripheral chips necessary for the operation of the microprocessor, memory device such as ROM, RAM and the like, and other peripheral components. The CPU 40 performs the various operations necessary for the management of the progressive bonus and the control of the various devices, in accordance with a program stored in the ROM.

The game display device 41 comprises the above mentioned video monitors 26 . . . and a drive circuit necessary for the display control of each video monitor 26, and displays the process of the slot machine game as the lottery game played in the progressive unit 3 and the result thereof on the video monitor 26 in accordance with the instruction from the CPU 40. The pool number display device 42 comprises the above mentioned segment type light emitting devices 25*a* . . . (refer to FIG. 7) and a drive circuit necessary for the control thereof, and displays the number of the medals to be paid out for each bonus winning combination in accordance with the instruction from the CPU 40. The electrically decorating display device 43 comprises various light emitting devices disposed at the electrically decorating portions 23 . . . and a drive circuit necessary for the lighting control thereof, and switches a light emitting pattern of each electrically decorating portion 23 in accordance with the instruction from the CPU 40. The communication controller 44 performs a data communication between the gaming machine 2 and the progressive unit 3 in accordance with the instruction from the CPU 40.

A pool number calculating section 45, a random number generator 46, a win judging section 47 and a pay-out adjusting section 48 are constituted within the CPU 40 by a combination of the microprocessor and a particular software. The pool number calculating section 45 counts up the assigned numbers of the medals for the progressive bonus calculated in the odds calculating section 36 in the gaming machines 2, and calculates the number of the medals to be paid out for each bonus winning combination in the slot machine game played in the progressive unit 3 based on the odds determined for each bonus winning combination and the sum of the numbers of the medals accumulated as the progressive bonuses in all of the gaming machines 2. The calculated numbers of the medals for the bonus winning combinations are displayed by the pool number display device 42. The number of the medals for each bonus winning combination is always stored in, for example, RAM mounted within the CPU 40.

The odds for the bonus winning combinations are changed depending on the rank of the bonus winning combinations as described below. That is, all of the medals accumulated as the progressive bonus at that time are paid out when the bonus winning combination of [777] is formed in the slot machine game played in the progressive unit 3. Half of the number of the medals in the case of [777] are paid out when the bonus winning combination of [333] is formed. One hundred medals are paid out irrespectively of the accumulated number of the progressive bonus medals when the bonus winning combination [???] is formed.

The random number generator 46 generates the random number necessary for the progress of the slot machine game in the progressive unit 3. The win judging section 47 determines a combination of the characters in each slot machine game played in the progressive unit 3 on the basis of the random number generated in the random number generator 46. The CPU 40 controls the game display device 42 so as to display the determined combination on the video monitors 26. The win judging section 47 also judges whether or not the determined combination corresponds to one of the bonus winning combinations, by referring to the data with regard to the bonus winning combinations stored within the ROM of the CPU 40. The pay-out adjusting section 48 manages the instruction with regard to the pay-out of the progressive bonus to each gaming machine 2, based on the number of the medals calculated by the pool number calculating section 45 and the judged result by the win judging section 47.

Next, the control procedures of the games in the CPUs 30, 40 of the progressive unit 3 and the gaming machine 2 are explained with reference to FIGS. 8 and 9.

Figure 8:
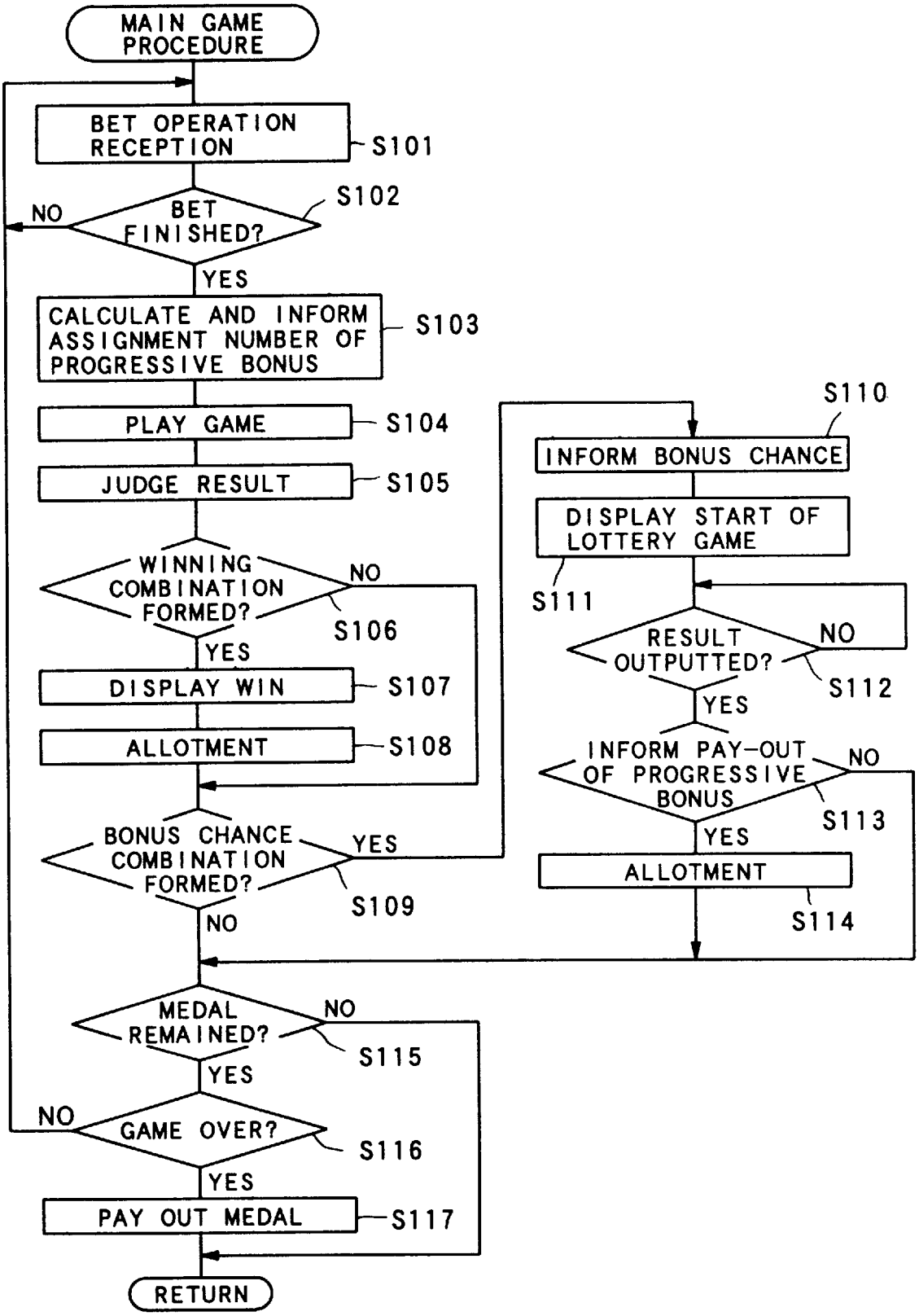
FIG. 8 is a flowchart showing a procedure of a main game played in a gaming machine.

When a medal is inserted into the medal insert slot 13*g* of the gaming machine 2 and then a signal corresponding thereto is sent from the medal input device 31 to the CPU 30 of the gaming machine 2, the CPU 30 executes a main game procedure shown in FIG. 8 as an interruption process. In this process, a bet operation is firstly received at a step S101, and then it is judged whether or not the bet operation is finished at a next step S102. The process at the step S101 is repeated until the judgment of the finish.

The bet operation implies an operation that a player instructs a number of bet medals among the inserted medals or the medals held as the credit medals, by using a particular button on the operation panel 13. Whether or not the bet operation is finished can be judged, for example, by specifying any one of the buttons 13*a* to 13*f* as a game start button and then detecting a presence or absence of the depression thereof. It may be judged as the bet finish if a next bet operation is not performed for a certain time after the last bet operation. A difference between the number of the inserted medals and the number of the bet medals is stored in a credit number store area within the RAM of the CPU 30 as the number of the credit medals.

If it is judged at the step S102 that the bet operation is finished, the operational flow proceeds to a step S103. At the step S103, the assigned number of the medals to be accumulated as the progressive bonus is calculated by the odds calculating section 36. The calculated number is informed through the communication controllers 35, 44 to the CPU 40 of the progressive unit 3. The pool number calculating section 45 of the CPU 40 responds to this information, and then calculates the numbers of the medals to be paid out for the bonus winning combinations, to thereby change the numbers displayed on the pool number display device 42.

At a next step S104, a random number is generated by the random number generator 37, and then a predetermined game is played. At this time, it can be possible to change the generation situation of the random number in reference with the operation of the player inputted through the operation panel 13. When the game is finished, the operational flow proceeds to a step S105 at which the played result is judged by the win judging section 38, and then proceeds to a step S106 at which the judgement as to whether or not the winning combination is formed is performed. If the winning combination is formed, a predetermined winning display is performed by the image display device 34 at a step S107. Then the number calculated by the odds calculating section 36 for the winning combination is added to the number of the credit medals at a next step S108. If the winning combination is not formed at the step S106, the procedures at steps S107 and S108 are omitted, and then the operational flow proceeds to a step S109.

At the step S109, it is judged whether or not the bonus chance combination for proceeding to the lottery game played in the progressive unit 3 is formed in the game based on the play result judged at the step S105. If it is judged that there is the bonus chance combination, the operation flow proceeds to a step S110. Then, information of the bonus chance is sent to the CPU 40 of the progressive unit 3. In response to this information, the CPU 40 starts a process shown in FIG. 9. The procedure of FIG. 9 is described later. At the step S110, it is necessary to send an inherent identification signal for each gaming machine 2 together with the above information so as to identify a gaming machine 2 in which the bonus chance combination is formed, At a next step S111, the image display device 34 displays information of starting the slot machine game in the progressive unit 3 to the player of the gaming machine 2. This may be displayed, for example, by using the entire screen of the monitor 15 or by using part of the progress information display 16 (refer to FIG. 4). After the display is started, the operational flow proceeds to a step S112, and waits until the game result is sent from the progressive unit 3. At this time, the process of the game may be sequentially sent from the progressive unit 3 to the gaming machine 2, and then the image similar to that on the video monitor 26 may be displayed on the monitor 15.

If the game result is sent from the progressive unit 3, the operational flow proceeds to a step S113. Then, it is judged whether or not a pay-out of the progressive bonus is informed. If the pay-out of the progressive bonus is informed, the operational flow proceeds to a step S114. Then, the number of the medals as the progressive bonus instructed by the progressive unit 3 is added to the credit number, and the operational flow proceeds to a step S115. If the pay-out of the progressive bonus is not informed at the step S113, the procedure at the step S114 is omitted.

At the step S115, it is judged whether or not a current credit number is 0. If it is 0, the game is over. If it is not 0, the operational flow proceeds to a step S116. At the step S116, it is judged whether or not the player instructs a game over. Whether or not the game is over can be judged, for example, by assigning any one of the buttons 13*a* to 13*f* to a medal pay-out button and then detecting a presence or absence of the depression thereof. If it is judged that the game is not over, the operational flow returns to the step S101. On the other hand, if it is judged that the game is over, the operational flow proceeds to a step S117. The medals having the number stored in the credit number store area at that time are paid out to the medal dish 14 by the medal output device 32. After that, the game process is completed. Then, the operational flow returns to a predetermined main routine process.

Figure 9:
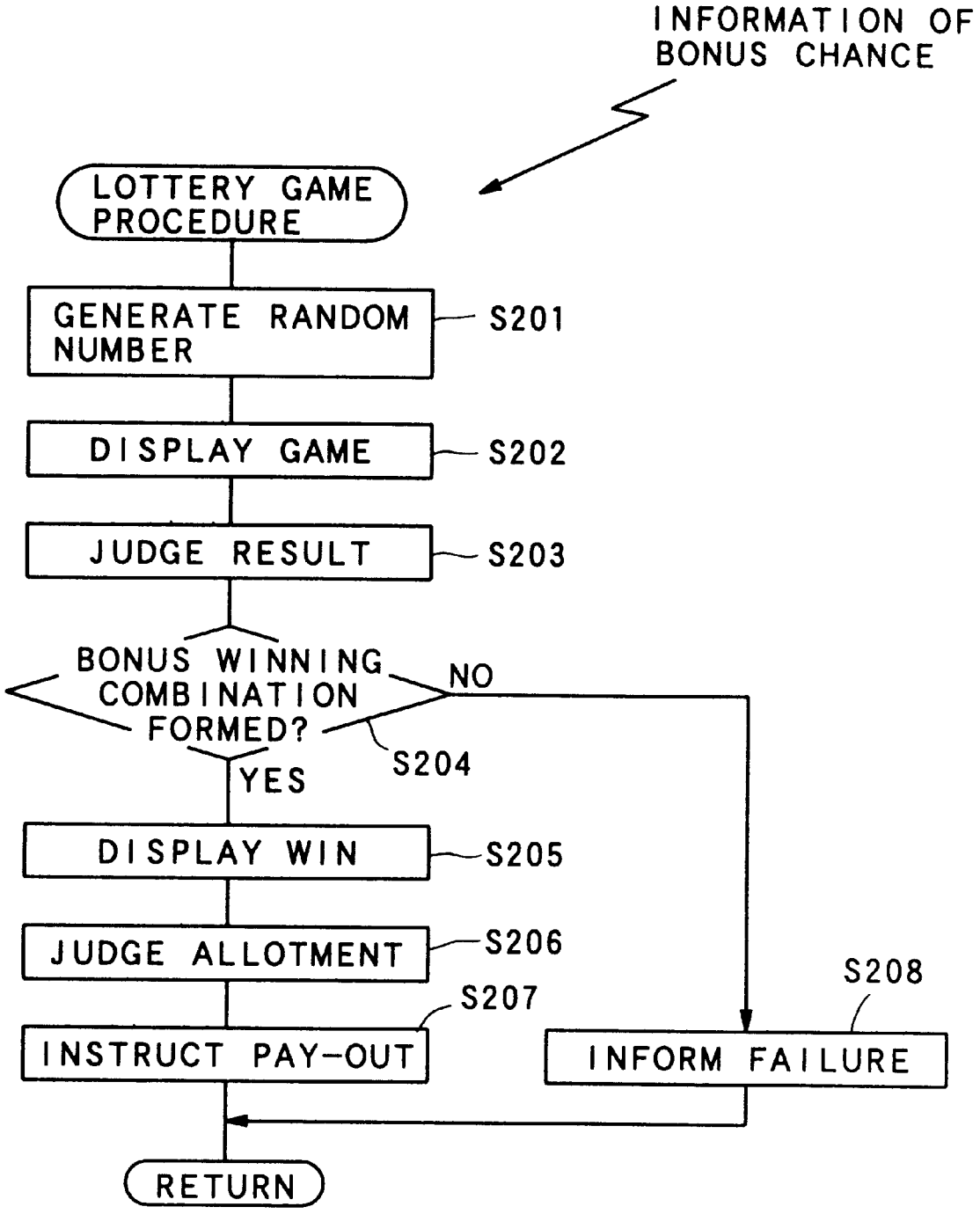
FIG. 9 is a flowchart showing a procedure of a lottery game played in the progressive unit.

When the CPU 30 of the gaming machine 2 sends, as mentioned above, the information of the bonus chance to the CPU 40 of the progressive unit 3 (at the step S110 in FIG. 8), the CPU 40 executes the lottery game procedure shown in FIG. 9 as an interrupt process. In this process, the random number is firstly generated by the random number generator 46 at a step S201 to thereby play the slot machine game for the progressive bonus. At a step S202, the process of the game is displayed by the game display device 41. At this time, as necessary, the generation situation of the random number may be changed in reference with the player's operation inputted through the operation panel 13.

When the game is finished, the operational flow proceeds to a step S203. Then, the play result is judged by the win judging section 47. At a next step S204, it is judged whether or not the bonus winning combination is formed. If the bonus winning combination is formed, a predetermined win display is performed by the electrically decorating device 43 at a step S205. At a next step S206, the number of the medals calculated by the pool number calculating section 45 is judged by the pay-out adjusting section 48. Moreover, at a step S207, the pay-out adjusting section 48 sends information of the pay-out of the progressive bonus with the number of the medals to be paid out as the progressive bonus to the CPU 30 of the gaming machine 2 at which the bonus winning combination has been formed. On the other hand, if the bonus winning combination is not formed at the step S204, the failure in the lottery game is informed to the CPU 30 at a step S208. After the procedure at the step S207 or S208, the lottery game procedure is completed. Then, the operational flow returns to the predetermined main routine.

In the above mentioned processes, let the number of the bet medals in each gaming machine 2 be $M_{bet}$, the number of the medals paid out to the player be $M_{out}$ and the number assigned as the progressive bonus be $M_{prog}$. Then, a relationship between them is set as follows.

At first, a pay out rate $P0_{set}$ (%) of the medal to the player is set by a following equation:

$$P0_{set}=(M_{out}/M_{bet})\times 100$$

When a pay out rate of the medal corresponding to the win in the gaming machine 2 included the pay out rate $P0_{set}$ is defined as $P0_{main}$, a difference between the $P0_{set}$ and the $P0_{main}$ is an assigned rate $P_{steel}$ of the medals to be assigned as the progressive bonus per the number of the bet medals. That is, it is given by a following equation:

$$P_{steel}=P0_{set}-P0_{main}$$

There may be a possibility that the pay out of the progressive bonus is generated, irrespectively of the fact that there is no accumulation of the progressive bonus, at the beginning of the game. Thus, it is necessary to pay out the minimum number of the medals as the progressive bonus even at that time, in order to excite the interest of the player to the progressive bonus. Then, it is necessary to set an initial number of the progressive bonus medals as $M_{ini}$ and then set a margin rate $P_{mar}$ in order to collect the initial number $M_{ini}$ from the medals bet by the player. For this reason, an actual assigned rate $P_{true}$ of the progressive bonus is given by a following equation:

$$P_{true}=P_{steel}-P_{mar}$$

Thus, an assigned number $M_{prog}$ of the medals as the progressive bonus is given by a following equation:

$$M_{prog}=M_{bet}\times P_{true}/100$$

For example, when the pay out rate $P0_{set}$ is 95% and a pay out rate for the winning combination in the main game played in the gaming machine 2 is 90%, then the $P_{steel}$ is 5%. Moreover, if the margin rate $P_{mar}$ is set as 1%, the assigned rate $P_{true}$ of the progressive bonus is 4%. In this case, if a bet number $M_{bet}$ is 100 pieces, four medals among them are accumulated as the progressive bonus, and the remnant 1% is reserved to collect the initial number $M_{ini}$.

In the gaming system 1 of this embodiment, different games can be played in the respective gaming machines 2, as mentioned above. However, in this case, the probabilities at which the bonus chance combinations are formed are different between the respective gaming machines 2. For this reason, the probabilities of the pay-outs of the progressive bonuses are varied between the respective gaming machines 2. Therefore, it is desirable to adjust the probabilities at which the bonus winning combinations are formed in the lottery games played in the progressive unit 3, in accordance with the type of the main game played in each gaming machine 2 to thereby make the probabilities of the pay-outs of the progressive bonuses substantially equal to each other. This adjustment is performed as follows, for example.

At first, three kinds of the bonus winning combinations are set as A, B and C in the lottery game played in the progressive unit 3. The probabilities at which the bonus winning combinations A, B and C are formed per a predetermined amount of the medals bet for the main game are defined as $P_{jabet}$, $P_{jbbet}$ and $P_{jcbet}$, respectively. Then, probabilities, at which the bonus chance combinations are formed, per the predetermined amount of the medals bet in the main game played in each gaming machine 2 are defined as $P_{chancebet}$. The value $P_{chancebet}$ is changed on the basis of the type of the main game. Then, probabilities $P_{ja}$, $P_{jb}$ and $P_{jc}$, at which the bonus winning combinations A, B and C are formed when the lottery games are performed a predetermined number of times in the progressive unit 3, are respectively defined as follows:

$$P_{ja}=P_{jabet}/(100/P_{chancebet})$$

$$P_{jb}=P_{jbbet}/(100/P_{chancebet})$$

$$P_{jc}=P_{jcbet}/(100/P_{chancebet})$$

Such an operation enables the probabilities at which the bonus winning combinations are formed to be varied on the basis of the probabilities $P_{chancebet}$ at which the bonus chance combinations are formed in the respective gaming machines 2. The values of the $P_{chancebet}$ are associated with the respective gaming machines 2 and stored in the ROM mounted in the progressive unit 3 in advance. Then, when the random number is generated at the step S201 in FIG. 9, the value is read by the pay-out adjusting section 48, and instructed to the random number generator 46. In this process, as long as the probabilities are different, the game is treated as the different type of the game. For example, the game in which the number of the reels in the slot machine game is different is treated as the different type of the game.

The present invention is not limited to the above mentioned embodiment. Thus, the various variations can be implemented. For example, a plurality of games may be selected in the progressive unit 3. It may be judged in the progressive unit 3 whether or not the bonus chance combination is formed in each gaming machine 2. However, the case in which the judgment is performed in each gaming machine 2 has a merit that the communication amount between the gaming machines 2 and the progressive unit 3 is reduced to thereby make the control easy.

The gaming system of the present invention is not limited to the system using the medals. The gaming system can be modified in such a manner that coins, tokens, bills or the like are be used to bet and to distribute the prizes to the player.

What is claimed is:

1. A progressive gaming system comprising:

a plurality of gaming machines, each of the gaining machines being constructed to perform a predetermined main game in response to an operation of a player and to give a prize to the player when a winning combination is formed in the main game; and a progressive unit for counting an amount of a progressive bonus based on an amount of a bet in the main game played in each of the gaming machines and controlling a payment of the progressive bonus in association with a result of the main game, wherein each of the gaming machines or the progressive unit is provided with a judging device for judging whether or not the result of the main game played in each of the gaming machines meets a predetermined bonus chance condition for proceeding to a lottery game, the progressive unit comprising a controller for performing the lottery game in response to a judgment that the result of the main game meets the bonus chance condition, for instructing one of the gaming machines, in which the result of the main game meets the bonus chance condition, to pay the progressive bonus corresponding to a result of the lottery game, and for displaying information regarding a process of the lottery game, the controller performing a game as the lottery game for forming at least one bonus winning combination and displaying a process as to whether or not the at least one bonus winning combination is formed.

2. A progressive gaming system according to claim 1, wherein the progressive unit comprises a display device extending on the plurality of the gaming machines, and the information regarding the process of the lottery game is displayed through the display device.

3. A progressive gaming system according to claim 1, wherein the progressive unit comprises a display device equipped with at least one video monitor for displaying the information regarding the process of the lottery game.

4. A progressive gaming system according to claim 3, wherein the controller performs a game as the lottery game in which predetermined number of characters are randomly combined or associated with each other, and controls the display device in such a manner that images representing a process of associating the characters are displayed on the at least one video monitor.

5. A progressive gaming system according to claim 3, wherein the controller randomly determines a combination of characters provided on a plurality of reels in the lottery game, and controls the display device in such a manner that images representing a process that each of the reels starts rotating and stops at a position corresponding to the determined combination of the characters are displayed on the at least one video monitor.

6. A progressive gaming system according to claim 5, wherein the controller performs a judgment as to whether or not the determined combination of the characters in the lottery game meets a predetermined bonus winning condition for paying the progressive bonus, and instructs the payment of the progressive bonus when it is judged that the determined combination of the characters meets the bonus winning condition.

7. A progressive gaming system according to claim 6, wherein a plurality of bonus winning combinations are set as the bonus winning condition, and the controller judges whether or not the determined combination meets at least one of the bonus winning combinations.

8. A progressive gaming system according to claim 7, wherein the controller determines a value to be paid to the player as the progressive bonus in such a manner that the value is changed in accordance with types of the bonus winning combinations, and instructs the one of the gaming machines to pay the determined value as the progressive bonus.

9. A progressive gaming system according to claim 1, wherein at least one bonus chance combination is set as the bonus chance condition for proceeding to the lottery game, and the judging device judges whether or not the at least one bonus chance combination is formed in the main game played in each of the gaming machines.

10. A progressive gaming system according to claim 9, wherein the at least one bonus chance combination includes a combination different from the winning combination.

11. A progressive gaming system according to claim 9, wherein the at least one bonus chance combination is limited to a combination different from the winning combination of the main game.

12. A progressive gaming system according to claim, wherein a part of the gaming machines can perform one type of a game, as the main game, different from another type of a game performed in a remnant part of the gaming machines as the main game, and wherein the controller performs a game for forming at least one bonus winning combination as the lottery game, instructs the payment of the progressive bonus when the at least one bonus winning combination is formed in the lottery game and changes a probability of forming the at least one bonus winning combination in accordance with a type of the main game.

13. A progressive gaming system according to claim 1, wherein the bonus chance condition is set in such a manner that a plurality of bonus chances can be occurred in one of the main game in anyone of the gaming machines, and the controller repeats the lottery game a number of times corresponding to a number of the bonus chances when the plurality of the bonus chances are occurred.

14. A progressive gaming system comprising:

plurality of gaming machines, each of which is constructed to perform a predetermined main game in response to an operation of a player and gives a prize to the player when a winning combination is formed in the main game; and a progressive unit for counting an amount of a progressive bonus based on an amount of a bet in the main game played in each of the gaming machines and controlling a payment of the progressive bonus in association with a result of the main game played in each of the gaming machines;

wherein each of the gaming machines or the progressive unit is provided with ajudging device for judging whether or not the result of the main game played in each of the gaming machines meets a predetermined bonus chance condition for proceeding to a lottery game;

and wherein the progressive unit comprises a controller for performing a game as the lottery game for forming at least one of bonus winning combinations in response to a judgment that the result of the main game meets the bonus chance condition, instructing one of the gaming machines, in which the result of the main game meets the bonus chance condition, to pay the progressive bonus varied in accordance with types of the bonus winning combinations when one of the bonus winning combinations is formed in the lottery game.

15. A progressive gaming system comprising:

a plurality of gaming machines, each of which is constructed to perform a predetermined main game in response to an operation of a player and gives a prize to the player when a winning combination is formed in the main game; and a progressive unit for counting an amount of a progressive bonus based on an amount of a bet in the main game played in each of the gaming machines and controlling a payment of the progressive bonus in association with a result of the main game played in each of the gaming machines;

wherein each of the gaming machines or the progressive unit is provided with a judging device for judging whether or not at lease one bonus chance combination including a combination different from the winning combination is formed in the main game played in each of the gaming machines;

and wherein the progressive unit comprises a controller for performing a lottery in response to a judgment that the at least one bonus chance combination is formed, instructing one of the gaming machines, in which the at least one bonus chance combination is formed, to pay the progressive bonus corresponding to a result of the lottery.

16. A progressive gaming system comprising:

a plurality of gaming machines, each of which is constructed to perform a predetermined main game in response to an operation of a player and gives a prize to the player when a winning combination is formed in the main game; and a progressive unit for counting an amount of a progressive bonus based on an amount of a bet in the main game played in each of the gaming machines and controlling a payment of the progressive bonus in association with a result of the main game played in each of the gaming machines;

wherein a part of the gaming machines can perform one type of a game as the main game different from another type of a game performed in a remnant part of the gaming machines as the main game;

wherein each of the gaming machines or the progressive unit is provided with ajudging device for judging whether or not the result of the main game played in each of the gaming machines meets a predetermined bonus chance condition varied in accordance with a type of the main game;

and wherein the progressive unit comprises a controller for performing a lottery game for forming at least one bonus winning combination in response to a judgment that the result of the main game meets the bonus chance condition, instructing one of the gaming machines, in which the result of the main game meets the bonus chance condition, to pay the progressive bonus when the at least one bonus winning combination is formed in the lottery game, and changing a probability of forming the at least one bonus winning combination in accordance with a type of the main game.

17. A progressive gaming system comprising:

a plurality of gaming machines, each of the gaming machines being constructed to perform a predetermined main game in response to an operation of a player and to give a prize to the player when a winning combination is formed in the main game; and a progressive unit for counting an amount of a progressive bonus based on an amount of a bet in the main game played in each of the gaming machines and controlling a payment of the progressive bonus in association with a result of the main game;

wherein each of the gaming machines or the progressive unit is provided with a judging device for judging whether or not the result of the main game played in each of the gaming machines meets a predetermined bonus chance condition for proceeding to a lottery game, the progressive unit comprising a controller for performing the lottery game in response to a judgment that the result of the main game meets the bonus chance condition, for instructing one of the gaming machines, in which the result of the main game meets the bonus chance condition, to pay the progressive bonus corresponding to a result of the lottery game, and for displaying information regarding to a process of the lottery game;

the progressive unit comprising a display device equipped with at least one video monitor for displaying the information regarding the process of the lottery game, the controller performing the lottery game in which a predetermined number of characters are randomly combined or associated with each other and controlling the display device in such a manner that images representing a process of associating the characters are displayed on the at least one video monitor.

18. A progressive gaming system comprising:

a plurality of gaming machines, each of the gaming machines being constructed to perform a predetermined main game in response to an operation of a player and to give a prize to the player when a winning combination is formed in the main game; and a progressive unit for counting an amount of a progressive bonus based on an amount of a bet in the main game played in each of the gaming machines and controlling a payment of the progressive bonus in association with a result of the main game;

wherein each of the gaming machines or the progressive unit is provided with a judging device for judging whether or not the result of the main game played in each of the gaming machines meets a predetermined bonus chance condition for proceeding to a lottery game, the progressive unit comprising a controller for performing the lottery game in response to a judgment that the result of the main game meets the bonus chance condition, for instructing one of the gaming machines, in which the result of the main game meets the bonus chance condition, to pay the progressive bonus corresponding to a result of the lottery game, and for displaying information regarding to a process of the lottery game;

the progressive unit comprising a display device equipped with at least one video monitor for displaying the information regarding the process of the lottery game, the controller randomly determining a combination of characters provided on a plurality of reels in the lottery game and controlling the display device in such a manner that images representing a process that each of the reels starts rotating and stops at a position corresponding to the determined combination of the characters are displayed on the at least one video monitor.

19. A progressive gaming system comprising:

a plurality of gaming machines, each of the gaming machines being constructed to perform a predetermined main game in response to an operation of a player and to give a prize to the player when a winning combination is formed in the main game; and a progressive unit for counting an amount of a progressive bonus based on an amount of a bet in the main game played in each of the gaming machines and controlling a payment of the progressive bonus in association with a result of the main game;

wherein each of the gaming machines or the progressive unit is provided with a judging device for judging whether or not the result of the main game played in each of the gaming machines meets a predetermined bonus chance condition for proceeding to a lottery game, the progressive unit comprising a controller for performing the lottery game in response to a judgment that the result of the main game meets the bonus chance condition, for instructing one of the gaming machines, in which the result of the main game meets the bonus chance condition, to pay the progressive bonus corresponding to a result of the lottery game, and for displaying information regarding to a process of the lottery game;

at least one bonus chance combination being set as the bonus chance condition for proceeding to the lottery game and the judging device judges whether or not the at least one bonus chance combination is formed in the main game played in each of the gaming machines.

20. A progressive gaming system comprising:

a plurality of gaming machines, each of the gaming machines being constructed to perform a predetermined main game in response to an operation of a player and to give a prize to the player when a winning combination is formed in the main game; and a progressive unit for counting an amount of a progressive bonus based on an amount of a bet in the main game played in each of the gaming machines and controlling a payment of the progressive bonus in association with a result of the main game;

wherein each of the gaming machines or the progressive unit is provided with a judging device for judging whether or not the result of the main game played in each of the gaming machines meets a predetermined bonus chance condition for proceeding to a lottery game, the progressive unit comprising a controller for performing the lottery game in response to a judgment that the result of the main game meets the bonus chance condition, for instructing one of the gaming machines, in which the result of the main game meets the bonus chance condition, to pay the progressive bonus corresponding to a result of the lottery game, and for displaying information regarding to a process of the lottery game;

the bonus chance condition being set in such a manner that a plurality of bonus chances can occur in one of the main games in anyone of the gaming machines and the controller repeats the lottery game a number of times corresponding to a number of the bonus chances when the plurality of the bonus chances occur.

* * * * *